US005154528A

United States Patent [19]

Cananzey et al.

[11] Patent Number: 5,154,528

[45] Date of Patent: Oct. 13, 1992

[54] U-BIND PAGE HOLDER

[76] Inventors: Gary M. Cananzey, 426 Main St., Wareham, Mass. 02571; Joseph Wilcox, 97 Crescent St., Northampton, Mass. 01060

[21] Appl. No.: 767,518

[22] Filed: Sep. 30, 1991

[51] Int. Cl.[5] ..... B42F 3/04

[52] U.S. Cl. ..... 402/19; 402/80 P; 402/75

[58] Field of Search ..... 402/19, 80 P, 75

[56] References Cited

U.S. PATENT DOCUMENTS

| | | | |
|---|---|---|---|
| 2,617,423 | 11/1952 | Miller | 402/19 |
| 2,878,815 | 3/1959 | Pluckebaum | 402/19 X |
| 2,904,899 | 9/1959 | Lloyd | 402/19 X |
| 2,935,986 | 5/1960 | Pluckebaum | 402/19 |
| 3,083,714 | 4/1963 | Foster | 402/75 X |
| 3,251,260 | 5/1966 | Serdfechny | 402/80 P X |
| 3,262,455 | 7/1966 | Shillinger | 402/75 X |
| 4,397,577 | 8/1983 | Bauer | 402/19 |

*Primary Examiner*—Paul A. Bell
*Attorney, Agent, or Firm*—James F. Baird

[57] ABSTRACT

The disclosed apparatus is a page holder to hold the sheets or pages in any book, album, loose leaf binder or other device that holds sheets or pages. The apparatus may be used in a book, album or binder whether it is manufactured by a heat seal, case made or other process. The apparatus is manufactured from a material that has a position memory. The material may be low density plastic but could be high density depending on the application.

1 Claim, 2 Drawing Sheets

U-BIND PAGE HOLDER

BACKGROUND OF THE INVENTION

Our invention is for use in the manufacture of any book, album or loose leaf binder, whether heat seal, case made or other process that requires the use of an apparatus to hold its contents.

The invention is a simple apparatus to hold pages or documentation in a book, album or binder. This invention will be used to hold, in a book or a binder, pages whether made of paper, plastic or card board, index sheets, documents relating to photo albums, magnetic pages, pocket pages or other such materials.

Another object of this invention is to provide a mechanism whereby sheets or pages may be attached to a book or binder with great speed and simple skills.

The photo album industry at present does not have available a low cost easily manufactured apparatus for securing the sheets or pages that may be adapted to a broad spectrum of applications. This invention provides the solution to this need.

The page holder may be manufactured of flexible low density plastic with a memory as to original position, the page holder has a base where it is secured by means to the book, album or binder, the page holder has an original shape in the form of a nearly complete almost circular loop. The original position is such as to prevent the sheets or pages from sliding free. The page holder is flexible to be "opened" to permit the insertion or removal of sheets and then return to the original position.

SUMMARY OF THE INVENTION

The apparatus disclosed in detail below is of a form that is both practical and economical in order to promote wide use. In addition to its preferred form, it may be made in a variety of sizes and shapes depending on the particular application involved. The number, size and shape would also vary according to the size of the sheets of pages involved. The page holder comprises an elongated object formed in an original shape that is a nearly complete almost circular loop. The page holder has a base end and a free end. The base end is secured by means to the book, album or binder involved. The means shown in the drawings is one of many that are readily available. The free end is positioned close enough to the base end in order to prevent pages or sheets from sliding free. The page holder is manufactured from a memory like material such as low density plastic. The memory features of the material used is to insure that the free end of the page holder may be opened from its original position to insert or remove sheets or pages and when released will return to its original position to prevent pages or sheets from sliding free.

BRIEF DESCRIPTION OF THE DRAWINGS

The object and features of the invention may be understood with reference to the following detailed description of an illustrative embodiment of the invention taken together with the accompanying drawings in which.

DESCRIPTION OF THE PREFERRED EMBODIMENT

Figure 1:
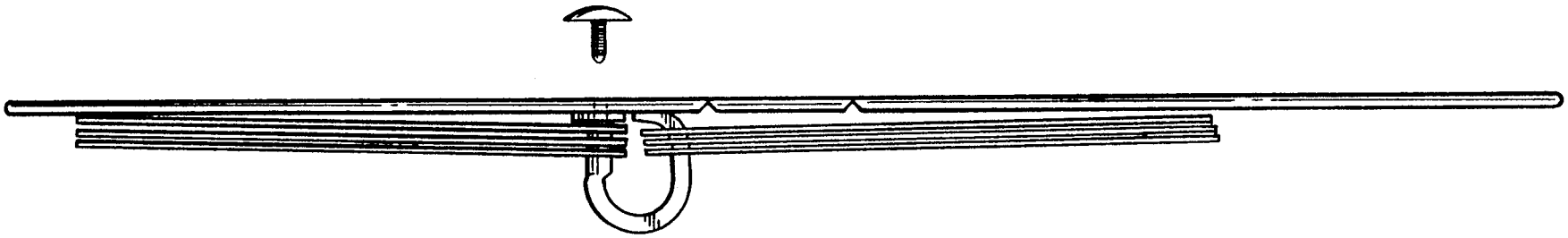
FIG. 1 illustrates an end view of an opened book, album or binder indicating one Page Holder positioned to hold the pages or sheets in place (additional Page Holders would be positioned behind the one shown). A securing means is indicated being inserted to hold the Page Holder to the book, album or binder.
Figure 2:
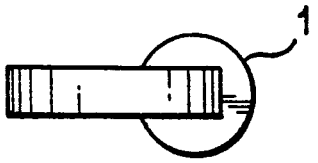
FIG. 2 illustrates a top view of the Page Holder indicating the base end (1).
Figure 2A:
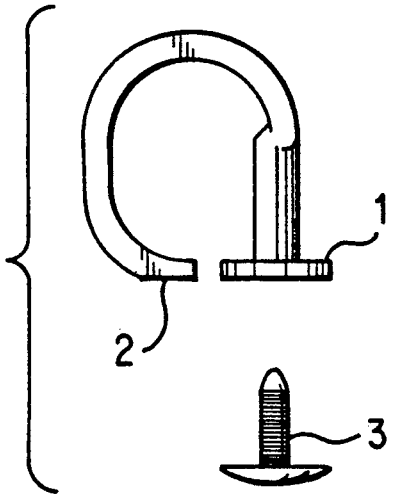
FIG. 2A illustrates an end view of the Page Holder in an original position indicating the base end (1) and the free end (2). Also indicated is a securing means (3) removed from the Page Holder.
Figure 2C:
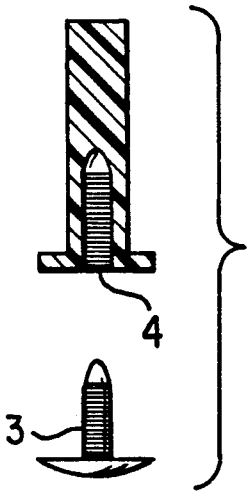
FIG. 2C illustrates an internal view showing the cavity (4) for insertion of the security means (3).
Figure 2B:
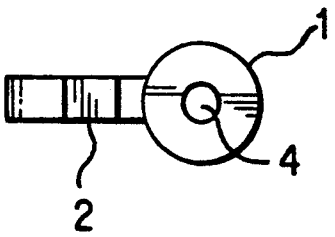
FIG. 2B illustrates a balloon view of the Page Holder indicating the base end (1) and the free end (2). Also shown is the cavity (4) for insertion of the securing means (3).

In FIG. 1 there is shown the Page Holder apparatus of the present invention as it would be attached to a book, album or binder. The securing means is also indicated. FIG. 2 shows a top view of the Page Holdeer showing the base end (1). FIG. 2A shows the Page Holder from the end in its original position indicating the nearly complete almost circular shape. The bottom end (1) and free end (2) are indicated. As can be seen the free end (2) is close enough to the base end (1) in order to prevent pages or sheets from sliding free. FIG. 2B and 2C show the securing means (3) and the manner of securing same in the hollow cavity (4). The Page Holder is manufactured using a flexible memory like material to permit opening the Page Holder to insert or remove pages or sheets however returning to it's original position once released in order to prevent pages or sheets from sliding free.

From the foregoing description it will be apparent that modification can be made to the apparatus without departing from the teaching of the present invention. Accordingly, it is distinctly understood that the invention is not limited to the preferred embodiment but may be embodied and practiced within the scope of the following claims.

What is claimed is:

1. Apparatus for securing sheets in a binder comprising:

an elongated object formed in an original shape that is a nearly complete almost circular loop, said object having a first end and a second end, said first end being enlarged in cross sectional area, having a flattened base and having a cylindrical shaped cavity in the base with a plurality of nearly equally spaced annular grooves on the cylindrical cavity surface, said grooves being parallel to the base, said second end being positioned, when the object is in said original shape, in order that it is close enough to the first end to prevent sheets from sliding free, said object being manufactured from a flexible memory like material such as low density plastic in order that the second end may be moved from the original position to an open position in order to insert or remove sheets and upon release the second end will return to the original position;

and a rivet shaped retaining plug, said plug having an enlarged flattened head shaped first end, a cylinder shaped body and a pointed shaped second end, said cylinder shaped body having a plurality of nearly equally spaced annular ribs that are parallel to the enlarged flattened head, said body being sized and shaped in order that the plug can be frictionally retained in the cavity of the object, whereby said plug can be used to secure the object to the binder.

* * * * *